United States Patent [19]

Hunter

[11] Patent Number: 4,797,035

[45] Date of Patent: Jan. 10, 1989

[54] METHOD OF INSTALLING A TEMPLATE ON THE SEAFLOOR

[75] Inventor: Andrew F. Hunter, Houston, Tex.

[73] Assignee: Conoco Inc., Ponca City, Okla.

[21] Appl. No.: 58,488

[22] Filed: Jun. 5, 1987

[51] Int. Cl.[4] ..... E02B 17/02

[52] U.S. Cl. ..... 405/205; 405/209; 405/224

[58] Field of Search ..... 405/195, 203, 205, 207, 405/209, 224

[56] References Cited

U.S. PATENT DOCUMENTS

| | | | |
|---|---|---|---|
| 3,572,044 | 3/1971 | Pogonowski | 405/204 |
| 4,039,025 | 8/1977 | Burkhardt et al. | 166/360 |
| 4,194,857 | 3/1980 | Chateau et al. | 405/203 |
| 4,273,471 | 6/1981 | Burke | 405/203 |
| 4,435,108 | 3/1984 | Hampton | 405/209 |

*Primary Examiner*—David H. Corbin

*Attorney, Agent, or Firm*—Richard K. Thomson

[57] ABSTRACT

A method of placing a template on the seafloor beneath a floating vessel. The method comprises suspending the template beneath at least one sling-mounted pendant buoy and using a tow cable and restraint cable to position the template in a position generally centered beneath the vessel. An extendable support, such as a drill string, may be connected to a previously attached descent sling, control lines and buoy slings detached, additional ballast added as needed, and the template lowered to the seafloor.

5 Claims, 1 Drawing Sheet

METHOD OF INSTALLING A TEMPLATE ON THE SEAFLOOR

The present invention pertains to a method for the placement of a drilling (or foundation) template on the floor of the ocean in deep water.

In the drilling of subsea oil and gas wells, drilling templates are frequently used to provide guidance for the drill string during drilling and to subsequently provide means to guide the wellhead, borehole casing, and the like, into proper position. A foundation template is typically placed on the ocean floor surrounding the drilling template to anchor the floating production platform in position. Various techniques have been proposed for situating a drilling or foundation template beneath a barge or floating platform to permit it to be rigged and lowered to the ocean floor. This technique is particularly applicable to installing components in water depths exceeding 1200 feet (366m).

Figure 1:
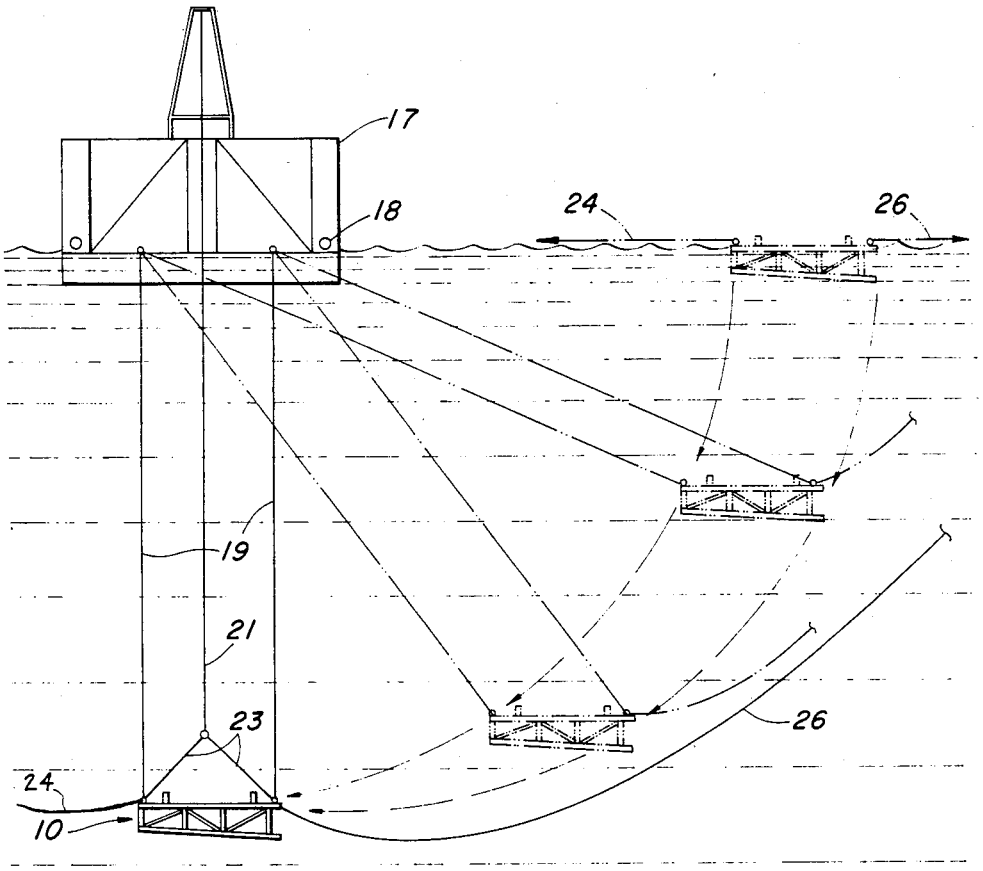
FIG. 1 PRIOR ART
FIG. 1 is a schematic depiction of a prior art placement method.
Figure 2:
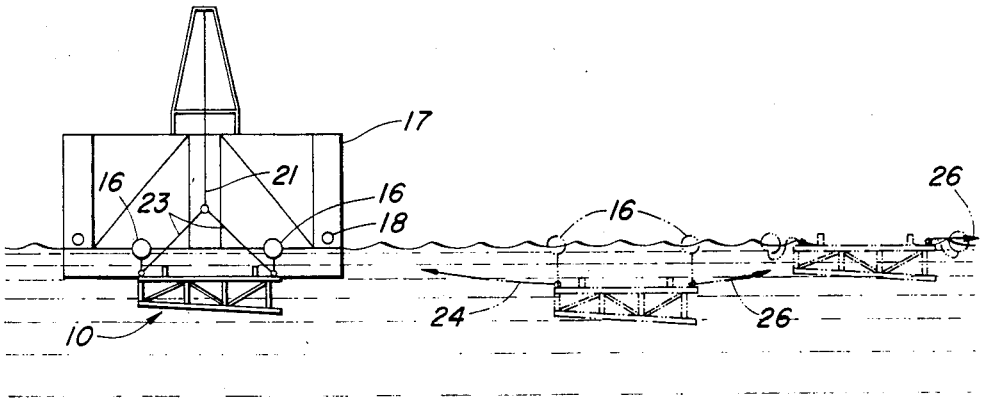
FIG. 2 is a schematic depiction of the installation technique of the present invention.

While the method of the present invention may be used with any drilling or foundation template, it is particularly adapted for use with the light-weight, modular template design described in copending U.S. patent application Ser. No. 055,678 [ICR 7910] filed May 29, 1987, which is hereby incorporated by reference, in pertinent part. FIG. 1 depicts a prior art technique for lowering a template to the seafloor known as the "keelhaul" method. In this method, the template 10 is launched from a barge or the like (not shown) adjacent the floating drilling platform 17. In this case, a semi-submersible drilling vessel is depicted. However, any other form of floating rig, barge or platform might be utilized with this method.

The light-weight tubular steel template 10 floats on the surface enabling attachment of (a) keelhaul slings 19, (b) descent support sling 23, (c) tow cable 24, and (d) restraining cable 26. Keelhaul slings 19 are approximately 300 feet long to avoid inadvertent contact between the template 10 and platform 17 caused by wave action that could damage either one or both of the template and platform. Tow cable 24 and restraining cable 26 are attached to first and second tugs or barges or the like (not shown) positioned on opposite sides of the platform and template to control the descent of the platform 10 to the solid line position shown in FIG. 1. Once all slings and cables are connected, template 10 is partially ballasted by flooding portions of the template frame to achieve the desired keelhaul weight. Restraining cable 26 is unreeled and the tug on tow cable 24 tightens the cable by a combination of reeling and relocating to facilitate the pendulumatic swing down depicted in FIG. 1. From this position (some 300 feet below the surface), the template is raised to a position 50 feet beneath the drilling vessel where a J-latch tool on the end of drill string 21 is connected to a bullnose attachment on descent sling 23. Then keelhaul slings 19, tow cable 24 and restraining cable 26 are removed and template 10 lowered to the ocean floor.

In the method of the present invention, pendant buoys 16 on short slings replace keelhaul slings 19 in the prior art method on the corners of template 10. Tow cable 24 and restraining cable 26 are attached to the centers of the ends of template 10, as was done in the previous method. Descent slings 23 with bullnose (not shown) are connected to the four corners of template 10. In addition, lateral control cables (not shown) are connected between the sides of the template and the pontoons on platform 17 to adjust the lateral position of the template 10 between the pontoons and ensure that the template and floating platform do not come into contact.

The tubular frame of template 10 is flooded sufficiently to submerge it and give it sufficient weight to be supported beneath pendant buoys 16. By reeling in tow line 24 and lateral control lines while letting out restraining line 26, template 10 can be drawn between the pontoons of the platform 17. The suspension of template 10 under buoys 16 ensures clearance under cross member 18 of floating platform 17. In an unballasted condition, the pile sleeves of template 10 project a distance above the water's surface sufficient to prevent the template from being able to float under cross member 18. Once in position beneath the moon pool, drill string 21 is connected to the bullnose using a j-latch tool (not shown), cables 24 and 26 along with buoys 16 are removed and the platform is flooded to its descent weight and lowered to the ocean floor, as before.

The method of the present invention takes significantly less time than the prior art keelhaul method. Accordingly, it is less expensive to employ. Further, in that four, 300 foot long slings are not being used, the probability of entanglement between slings and cables is significantly reduced and method reliability and corresponding contractor confidence are enhanced.

While the present method has been solely described in conjunction with the placement of a drilling template beneath a semi-submersible drilling vessel using a drill string, it will be apparent that this method might be employed to place another type of template such as a foundation template, for example, beneath another type of vessel such as a barge or the like, using another extendable support means to lower it, such as a cable system.

Various changes, alternatives and modifications will become apparent to a person of ordinary skill in the art following a reading of the foregoing specification. Accordingly, it is intended that all such changes, alternatives and modifications as come within the scope of the appended claims be considered part of the present invention.

I claim:

1. A method for placing a template on the sea floor beneath a floating vessel comprising:

a. securing at least one pendant buoy to said template;
b. securing a tow cable to a first end of said template and a restraining cable to a second end of said template;
c. securing at least one descent sling to a plurality of corners of said template;
d. ballasting said template, as necessary, such that said template is suspended beneath said pendant buoy to avoid interference with said floating vessel;
e. reeling in said tow cable and unreeling said restraining cable to move said template to a position generally centered beneath said floating vessel;
f. connecting an extendable support means to said at least one descent sling;
g. disconnecting said tow cable, said restraining cable and said at least one pendant buoy;
h. lowering said template to the ocean floor using said extendable support means.

2. The method of claim 1 wherein said step of securing said descent sling is performed prior to said ballasting step.

3. The method of claim 1 further comprising the step of attaching lateral control lines to said template prior to the ballasting step.

4. The method of claim 1 wherein said ballasting step is performed by flooding at least a portion of said template.

5. The method of claim 1 wherein the step of connecting an extendable support means comprises connecting said at least one descent sling to an end of a drill string.

* * * * *